US007414189B2

(12) United States Patent
Griess

(10) Patent No.: US 7,414,189 B2
(45) Date of Patent: Aug. 19, 2008

(54) INTEGRATED WIRING FOR COMPOSITE STRUCTURES

(75) Inventor: Kenneth H. Griess, Kent, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/163,001

(22) Filed: Sep. 30, 2005

(65) Prior Publication Data

US 2008/0115954 A1 May 22, 2008

(51) Int. Cl.
*H01B 7/00* (2006.01)
*H01B 7/34* (2006.01)

(52) U.S. Cl. ..... 174/36; 174/110 R; 174/113 R; 174/119 R

(58) Field of Classification Search ..... 174/110 R, 174/113 R, 119 R, 119 C, 120 R, 120 SC, 174/126.2

See application file for complete search history.

(56) References Cited

U.S. PATENT DOCUMENTS 2,663,752 A * 12/1953 Wier ..... 174/36
3,284,751 A * 11/1966 Barker et al. ..... 338/66
3,795,559 A * 3/1974 Horn et al. ..... 156/152
3,870,987 A * 3/1975 Wiley et al. ..... 338/214
3,900,701 A * 8/1975 Bayles et al. ..... 174/102 R
3,946,124 A 3/1976 Mee et al.
3,969,816 A 7/1976 Swengel, Sr. et al.
5,034,719 A * 7/1991 Brown et al. ..... 338/66
5,475,185 A * 12/1995 Tokarsky ..... 174/36
5,796,043 A * 8/1998 Maruyama ..... 174/102 SC
6,005,191 A * 12/1999 Tzeng et al. ..... 174/102 R
6,225,565 B1 * 5/2001 Prysner ..... 174/120 SC
6,243,635 B1 6/2001 Swan et al.
6,659,402 B1 12/2003 Prochaska
2004/0055780 A1 * 3/2004 Hakkarainen et al. ... 174/120 R
2005/0006126 A1 * 1/2005 Aisenbrey ..... 174/68.1

FOREIGN PATENT DOCUMENTS

DE 2614195 A1 10/1977
DE 195 39 257 C1 * 10/1996
DE 19539257 C1 10/1996
GB 1 178 767 * 1/1970
GB 1178767 A 1/1970

* cited by examiner

*Primary Examiner*—William H. Mayo, III
(74) *Attorney, Agent, or Firm*—Ostrager Chong Flaherty & Broitman P.C.

(57) ABSTRACT

A wire for integration with an airplane composite structure material includes a conductive core surrounded by an isolation layer for substantially isolating the conductive core from the composite structure material. The isolation layer includes braided fibers, and the braided fibers include a material having at least substantially similar properties as the composite structure material.

19 Claims, 4 Drawing Sheets

INTEGRATED WIRING FOR COMPOSITE STRUCTURES

TECHNICAL FIELD

The present invention relates generally to an aircraft composite structure and more particularly to wiring integratable with an aircraft composite structure.

BACKGROUND OF THE INVENTION

Composite structures include a complex material, such as graphite, in which two or more distinct, structurally complementary substances combine to produce structural or functional properties not present in any individual component. In other words, composite structures have increased strength over the individual components thereof. Generally, the component parts include a composite structure having a core material, a reinforcing material, and a resin binder. Each of these substances alone provides limited strength, but combined properly they become a strong composite structure.

In aircraft construction, composite structures often include various fiber forms and resin combinations in which the fiber form is embedded in the resin while still retaining its identity. Advanced composite airplane materials include high strength fibers embedded in an epoxy matrix. These composites provide for major weight savings in airplane structures due to high strength to weight ratios.

Currently, wiring systems are generally not "buried" within composite structures, as this could possibly lead to difficulties analyzing structural strength of the composite structure and inspection of the wiring systems.

It would therefore be highly desirable to have an aircraft composite structure system with wiring integrated into the composite material.

SUMMARY OF THE INVENTION

In accordance with one embodiment of the present invention, a wire for integration with an airplane composite structure material includes a conductive core surrounded by an isolation layer for substantially isolating the conductive core from the composite structure material. The isolation layer includes braided fibers, and the braided fibers include a material having at least substantially similar properties as the composite structure material.

In general terms, integration of two or more separate parts such as composite structures and wires, as in the present invention, may save weight and cost. The present invention may also contribute to the structural capabilities (e.g. carry load) for composite structures and thereby provide weight savings over prior wiring systems. In addition, eliminating wiring support features, such as clips and brackets, through implementation of the present invention, may add further weight savings.

Other objects and advantages of the present invention will become apparent when viewed in light of the detailed description and preferred embodiment when taken in conjunction with the attached drawings and claims.

BRIEF DESCRIPTION OF THE DRAWINGS

For a complete understanding of the invention, there will now be described some embodiments thereof, given by way of example, reference being made to the accompanying drawings, in which.

DESCRIPTION OF PREFERRED EMBODIMENTS

Figure 1:
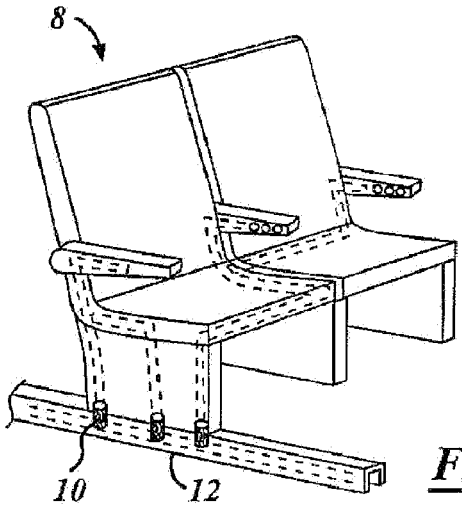
FIG. 1 is a perspective view of an aircraft composite structure system in accordance with the present invention.

The present invention is illustrated with respect to a wire 10 for integrating with a composite structure material, particularly suited to the aerospace field. The present invention is, however, applicable to various other uses that may require wiring systems, as will be understood by one skilled in the art. In each of the following figures, the same reference numerals are used to refer to the same components.

FIG. 1 illustrates an airplane system 8 including a wire 10 integrated with a composite structure airplane floor panel and seat track 12 (composite structure material). The wire 10 includes fiber-braiding technology of conductive fibers or filaments and electrically insulative fibers, such as glass, for creating a controlled conductive path on the composite structure material.

Figure 2:
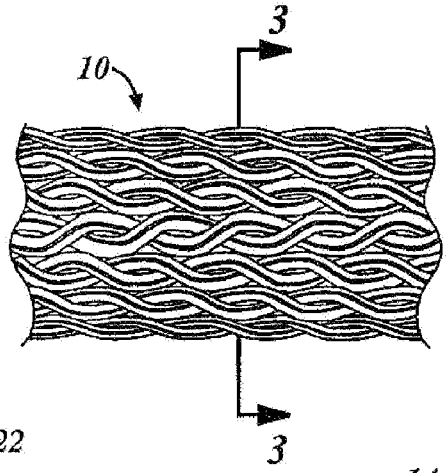
FIG. 2 is a side view of a wire system for use in the aircraft composite structure system of FIG. 1.
Figure 3A:
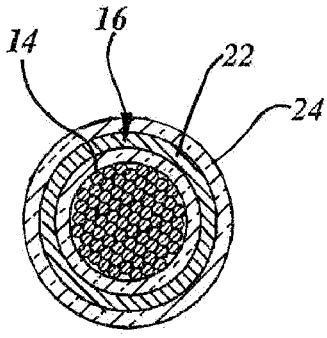
FIG. 3A is a cross-sectional view of the wire system of FIG. 2 looking in the direction of 3-3 in accordance with one embodiment of the present invention.
Figure 3B:
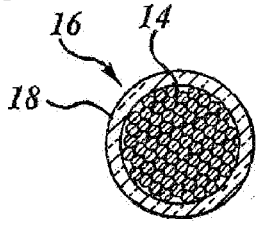
FIG. 3B is a cross-sectional view of the wire system of FIG. 2 looking in the direction of 3-3 in accordance with another embodiment of the present invention.

Referring to FIGS. 2, 3A, and 3B, the wire 10 is illustrated in accordance with further embodiments of the present invention. The wire 10 is impregnated with a resin or an adhesive, however, a dry non-impregnated wire is also included as an alternate embodiment.

Figure 4:
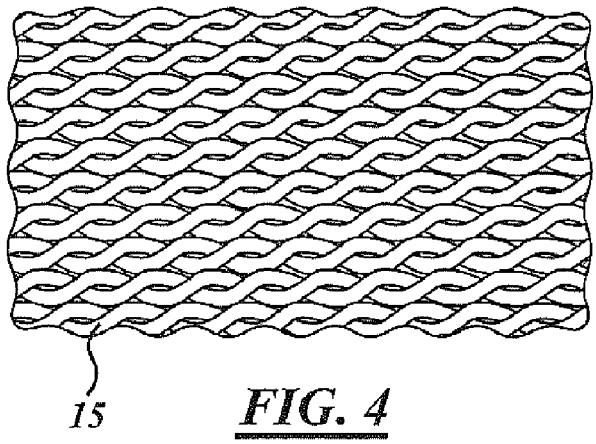
FIG. 4 is a schematic view of a conductive element of the wire system of FIG. 1 in accordance with another embodiment of the present invention.
Figure 6:
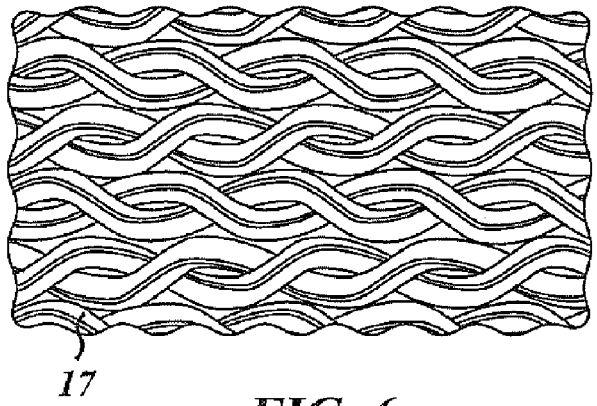
FIG. 6 is a schematic view of a conductive element of the wire system of FIG. 1 in accordance with another embodiment of the present invention.

In FIG. 3B, the wire 10 includes a first conductive core 14 or first conductive wire element surrounded by an isolation layer 16 or substantially non-conductive layer for substantially isolating the first conductive core 14 from the composite structure. The core 14 may include braided conductive fibers 15, as in FIG. 4, a combination 17 of braided conductive fibers and braided non-conductive fibers as in FIG. 6, or straight, substantially parallel wire fibers. The conductive elements or conductive core 14 may be either a commonly used fiber (e.g.

graphite, glass, or Kevlar) that has been specially treated (e.g. vapor deposition) with a conductive coating, or a metallic wire/filament (e.g. singular wire or braided filaments or wires).

In accordance with an alternate embodiment of the present invention, FIG. 3A illustrates the wire of FIG. 2 looking in the direction of 3-3. The wire 10 includes the conductive core 14, the first isolation layer 16, and a shielding layer 22 or second conductive wire element substantially surrounding the first isolation layer 16, which may include a braided conductive material. The wire 10 also includes an outer isolation layer 24 or second non-conductive layer substantially surrounding the shielding layer 22.

Figure 5:
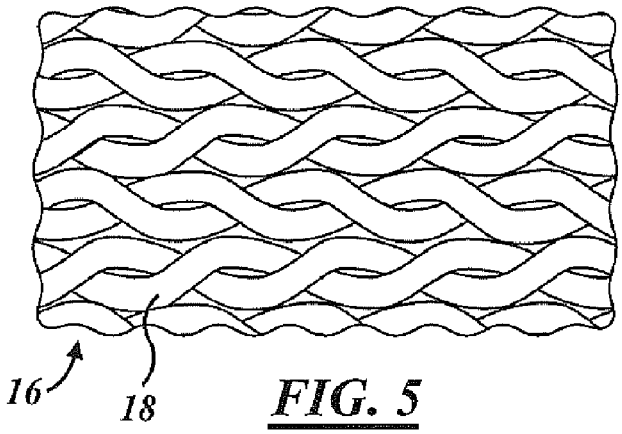
FIG. 5 is a schematic view of an isolation layer of the wire system of FIG. 1 in accordance with another embodiment of the present invention.

The first isolation layer 16 includes braided non-conductive fibers 18, as illustrated in FIG. 5. The braided fibers 18, which may be glass-braided tubes, include a material (e.g. the non-conductive fibers) having at least substantially similar properties (e.g. mechanical or structural) as the composite structure material. The most common structural material for composite structures is graphite, which is partially conductive, because of its strength to weight ratio. Important to note is that including a percentage of glass within graphite will provide a stronger overall wire. The isolation layers isolate electrically the conductive fibers/filaments of the core 14 from the graphite.

The shielding layer 22 includes a shielding material, which may be the same as or similar to the material used for the conductive core 14. Through alternating the different braided layers in order to shield the inner conductive core, the wire 10 a coaxial conductor may be fabricated.

The first conductive core 14, the isolation layers 16, 24, and the shielding layers 22 may share a structural load with the composite structure material. All components of the wire 10 are also integratable with the composite structure, such that structural integrity of the composite structure is substantially constant following integration of the wire 10.

The conductors or conductive core 14 may be multi-strand wire filaments or an inter-woven combination of wire and glass. The core 14 may then be encased in an additional tube or sock (e.g. isolation layer 16) of woven glass, which acts as an insulator. Another embodiment includes surrounding the insulated core 14 in a braided metal sleeve conductor as shielding 22, which is then surrounded with a sleeve of woven glass (outer isolation layer 24 or second isolation layer). One or more of these alternating layers of conductor and insulator is treated with resin such that when the entire wire 10 is cured, it is saturated with resin and becomes an integral part of the composite structure. Further, the wire 10 can be cured such that the glass is almost transparent, such that the conductor remains visible for inspection or failure analysis.

Figure 7:
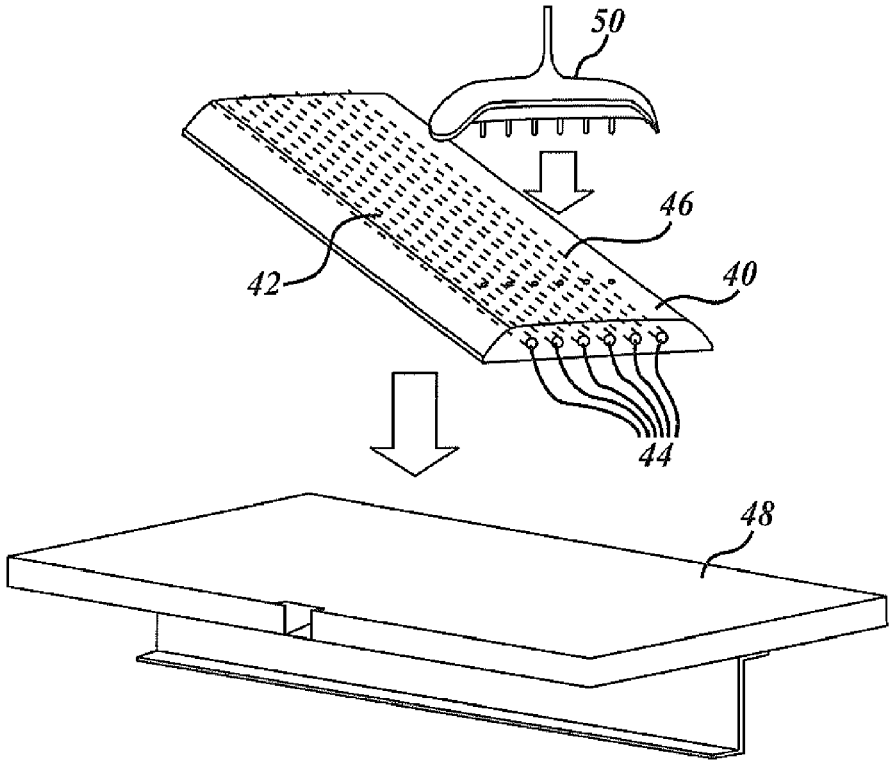
FIG. 7 is an exploded view of a multi-conduit wire system in accordance with another embodiment of the present invention.
Figure 8:
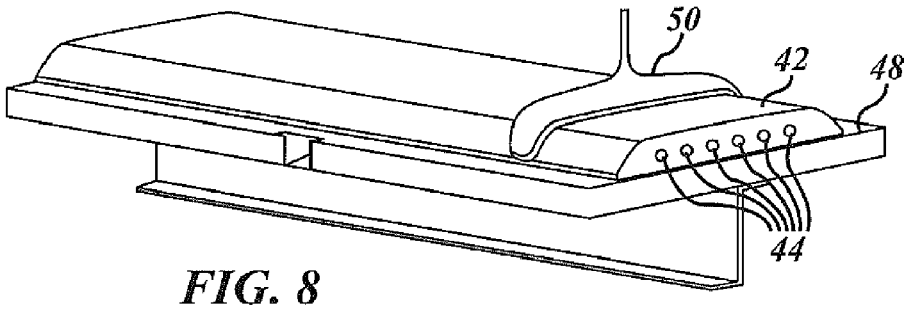
FIG. 8 is a perspective view of the multi-conduit wire system of FIG. 7.

Referring to FIGS. 7-8, a multi-conduit wire system 40 for integrating with an airplane composite structure is illustrated. The system 40 includes a housing 42; a plurality of wires 44 within the housing 42, wherein a non-conductive material 46, stitched within the housing 42, electrically isolates each of the plurality of wires 44. The housing 42 is embodied as a strip wire, such that the housing may be cut to a desired length and attached to a structure 48. The plurality of wires 44 may be accessed through a plug 50. The housing 42 and the plurality of wires 44 may be integratable with the airplane composite structure, such that structural integrity of the composite structure is substantially constant following integration of the wires 44.

The housing 42 may include a filler material, such that the plurality of wires 44 is arranged similarly to those in FIGS. 9-11 below, whereby the filler material is formed thereabout to a predetermined shape. The predetermined shape may be similar to the one illustrated, including tapered edges, or may be any other known shape. Further, the housing 42 may include a pigment for matching the color of the housing 42 to a component or structure.

Figure 9:
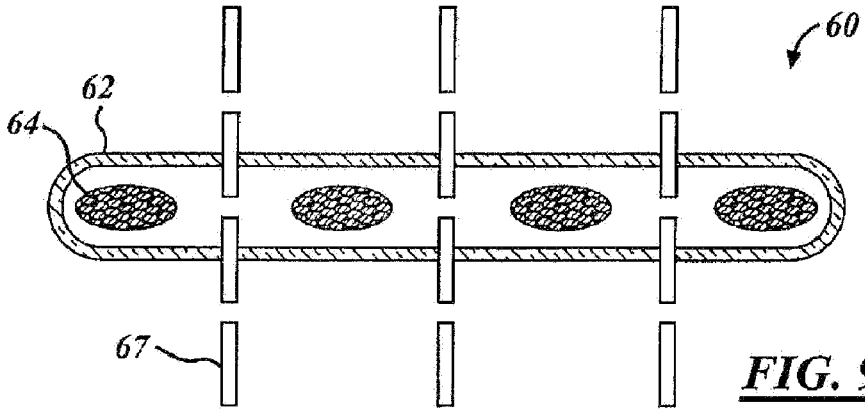
FIG. 9 is a schematic view of a multi-conduit wire system in accordance with another embodiment of the present invention.
Figure 10:
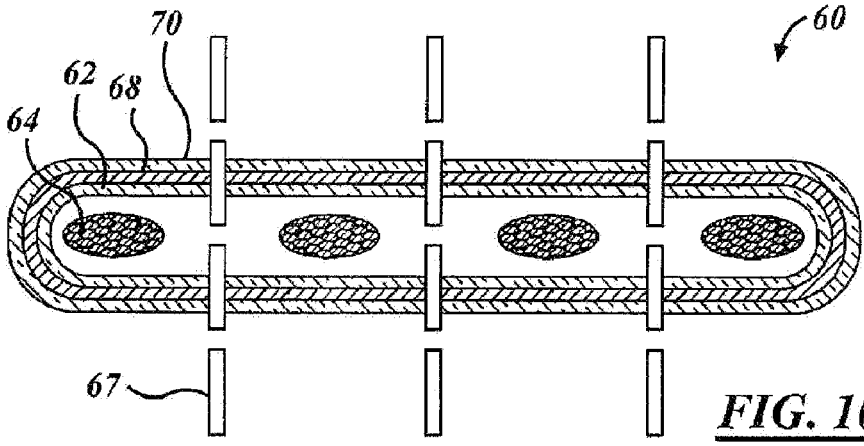
FIG. 10 is a schematic view of a multi-conduit wire system in accordance with another embodiment of the present invention.
Figure 11:
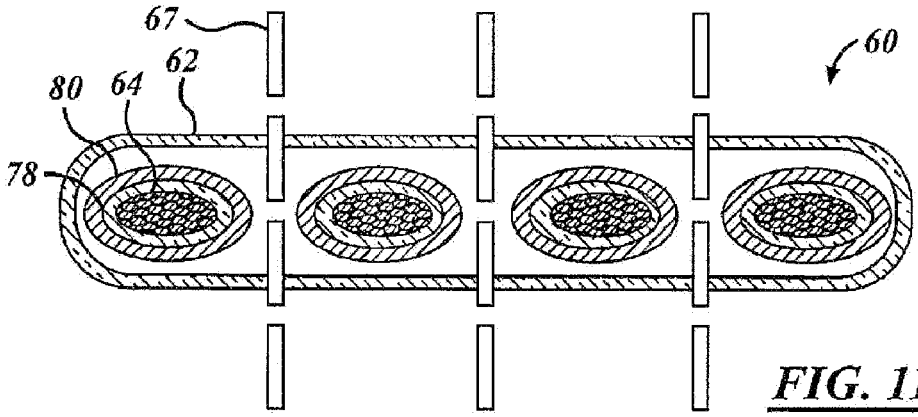
FIG. 11 is a schematic view of a multi-conduit wire system in accordance with another embodiment of the present invention.

Referring to FIGS. 9-11, a multi-conduit wire system 60 in accordance with another embodiment of the present invention is illustrated. Important to note is that the multi-conduit wire system 60 may be the same as the multi-conduit wire system 40, illustrated above as a strip wire, or may be directly integrated into an airplane composite structure. In FIG. 9 the multi-conduit wire system 60 includes a first isolation layer 62 substantially surrounding all of the plurality of wires 64 (plurality of conductive wire elements) and including braided fibers. As with previous embodiments, the wires 64 may include conductive braided fibers or non-conductive fibers braided with conductive braided fibers or coated fibers. Further, the plurality of wires 64 may be electrically isolated from each other through non-conductive stitching 67.

Referring to FIG. 10, the multi-conduit wire system 60 is illustrated including a shielding layer 68 substantially surrounding the first isolation layer 62 and including a braided conductive material. The multi-conduit wire system 60 further includes a second isolation layer 70 substantially surrounding the shielding layer 68.

Referring to FIG. 11, the multi-conduit wire system 60 of FIG. 9 is illustrated wherein each of the plurality of wires 64 include a second isolation layer 78. Also, each of the plurality of wires 64 further includes a shielding layer 80 substantially surrounding the second isolation layer 78.

Figure 12:
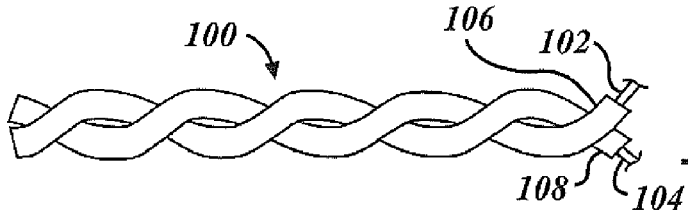
FIG. 12 is a perspective view of a wire system in accordance with another embodiment of the present invention.

Referring to FIG. 12, an alternate embodiment of the present invention is illustrated wherein the wire 100 further includes a first conductive core 102 and a second conductive core 104 having a first and second isolation layer 106, 108 respectively. The second conductive core 104 and the second isolation layer 108 are wound with the first conductive core 102 and the first isolation layer 106 for improving electrical properties of each conductive core.

For installation on a cured part, resin or adhesive may be applied to the wire locally, thereby impregnating the wire. As mentioned, the assembled integrated wiring may also be infused with a resin, which may be similar to the prepreg process that is used in common composite materials, which would then be stored and handled like common prepreg material. In wet lay-up type systems, the conductor or wire may absorb resin, as may the composite structure.

As previously discussed, the materials of the present invention are compatible with airplane composite structures, and durability of the wire is tailored to aircraft weight demands.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A wire for integrating with a composite structure material, the wire comprising:

a first conductive core comprising a conductive material wherein said conductive material comprises at least one of conductive braided fibers and conductively coated braided fibers and said conductive material comprises non-conductive fibers braided with one of said conductive braided fibers and said conductively coated braided fibers;

a first isolation layer directly surrounding said first conductive core for substantially isolating said first conductive core from the composite structure, said first isolation layer comprising braided fibers, said braided fibers comprising a material comprising at least substantially similar properties as the composite structure material; and a shielding layer directly surrounding said first isolation layer and comprising at least one of a braided conductive material and a conductively coated braided material;

a second conductive core;

a second isolation layer substantially surrounding said shielding layer;

wherein said first conductive core, said first isolation layer, said second conductive core and said second isolation layer are integratable with the composite structure such that structural integrity of the composite structure is substantially constant following integration of the wire.

2. The wire of claim 1, wherein at least one of a resin and an adhesive impregnates said first conductive core and said first isolation layer.

3. The wire of claim 1, wherein said first conductive core and said first isolation layer are adapted to share a structural load with the composite structure material.

4. The wire of claim 1, wherein said second conductive core and said second isolation layer are wound with said first conductive core and said first isolation layer.

5. A multi-conduit wire system for integrating with an airplane composite structure, the system comprising:

a housing;

a plurality of wires within said housing, wherein a non-conductive material stitched within said housing electrically isolates each of said plurality of wires; and a first isolation layer within said housing directly surrounding all of said plurality of wires, said isolation layer comprising braided fibers, said braided fibers comprising a material comprising at least substantially the same material properties as the composite structure;

wherein said housing and said plurality of wires are integratable with the airplane composite structure such that structural integrity of the composite structure is substantially constant following integration of the wire system.

6. The multi-conduit wire system in claim 5, wherein each of said plurality of wires comprises conductive braided fibers.

7. The multi-conduit wire system of claim 6, wherein each of said plurality of wires further comprises non-conductive fibers braided with said conductive braided fibers.

8. The multi-conduit wire system of claim 5, wherein each of said plurality of wires further comprising a second isolation layer.

9. The multi-conduit wire system of claim 8, wherein each of said plurality of wires further comprising a shielding layer directly surrounding said second isolation layer and comprising a braided conductive material.

10. The multi-conduit wire system of claim 9, wherein each of said wires further comprising an outer isolation layer directly surrounding said shielding layer.

11. The multi-conduit wire system of claim 5 further comprising a shielding layer directly surrounding said first isolation layer and comprising a braided conductive material.

12. The multi-conduit wire system of claim 11 further comprising a second isolation layer directly surrounding said shielding layer.

13. The multi-conduit wire system of claim 12 further comprising a resin infused within said non-conductive material.

14. A wire system integrated within an airplane composite structure, said system comprising:

a first conductive wire element;

a braided, substantially non-conductive layer electrically isolating said first conductive wire element from the airplane composite structure; and a shielding layer electrically shielding said first conductive wire element, wherein said first conductive wire element, said non-conductive layer, and said shielding layer comprise composite structure materials such that said first conductive wire element, said substantially non-conductive layer, and said shielding layer share a structural load with the airplane composite structure and are integratable with the composite structure such that the structural integrity of the composite structure is substantially constant following integration of the first conductive wire element.

15. The wire system of claim 14, wherein said conductive element comprises at least one of conductive braided fibers and nonconductive braided fibers.

16. The wire system of claim 14 further comprising an outer isolation layer substantially surrounding said shielding layer.

17. The wire system of claim 14 further comprising a second conductive wire element having a second non-conductive layer.

18. The wire system of claim 14 further comprising a plurality of conductive elements, wherein a non-conductive material electrically isolates each of said plurality of conductive wire elements and said first conductive wire element.

19. The wire system of claim 18, wherein each of said plurality of wires further comprising a shielding layer.

* * * * *